US008425292B2

(12) United States Patent
Lui et al.

(10) Patent No.: US 8,425,292 B2
(45) Date of Patent: Apr. 23, 2013

(54) SYSTEM AND METHOD FOR ANALYZING POSTURES

(75) Inventors: Ho Leung Lui, Wanchai (HK); Dennis Sai Kit Lai, Wanchai (HK); Ho Kit Cheung, Wanchai (HK); Man Yuen Cheng, Wanchai (HK); Donghui Xia, Wanchai (HK)

(73) Assignee: Perception Digital Limited, Wanchai (HK)

( * ) Notice: Subject to any disclaimer, the term of this patent is extended or adjusted under 35 U.S.C. 154(b) by 0 days.

(21) Appl. No.: 13/329,400

(22) Filed: Dec. 19, 2011

(65) Prior Publication Data

US 2012/0296454 A1 Nov. 22, 2012

(30) Foreign Application Priority Data

May 20, 2011 (CN) ..... 2011 1 0132576
Oct. 12, 2011 (CN) ..... 2011 1 0308522

(51) Int. Cl.
*A63F 9/24* (2006.01)

(52) U.S. Cl.
USPC ..... 463/3; 473/223

(58) Field of Classification Search ..... 463/3; 473/151, 473/209, 220–221, 274, 278, 407
See application file for complete search history.

(56) References Cited

U.S. PATENT DOCUMENTS

| | | | | |
|---|---|---|---|---|
| 7,850,536 | B1 * | 12/2010 | Fitzgerald | 473/220 |
| 8,109,816 | B1 * | 2/2012 | Grober | 463/3 |
| 2003/0207718 | A1 * | 11/2003 | Perlmutter | 473/221 |
| 2004/0033843 | A1 * | 2/2004 | Miller et al. | 473/274 |
| 2006/0111197 | A1 * | 5/2006 | Yamamoto et al. | 473/151 |
| 2007/0105639 | A1 * | 5/2007 | Hasegawa | 473/221 |
| 2007/0167251 | A1 * | 7/2007 | Pathross et al. | 473/278 |
| 2009/0233735 | A1 * | 9/2009 | Savarese et al. | 473/407 |
| 2009/0239673 | A1 * | 9/2009 | Drimer | 473/209 |
| 2009/0321289 | A1 * | 12/2009 | LaSala | 206/315.2 |
| 2010/0063352 | A1 * | 3/2010 | Matsuura | 600/103 |
| 2010/0125816 | A1 * | 5/2010 | Bezos | 715/863 |

* cited by examiner

*Primary Examiner* — Dmitry Suhol
*Assistant Examiner* — Jason Yen
(74) *Attorney, Agent, or Firm* — Rosenberg, Klein & Lee

(57) ABSTRACT

A posture analyzing system has a collecting apparatus disposed on a handle of a sports apparatus and is configured to collect and transmit data of the sports apparatus. A mobile terminal is configured to read the data and to draw a moving path of the sports apparatus according to the data and shape of the sports apparatus. Further, a posture analyzing system collects and sends data of the sports apparatus by a collecting apparatus disposed on a handle of the sports apparatus and receives the data and draws a moving path of the sports apparatus according to the data and shape of the sports apparatus by a mobile terminal.

23 Claims, 10 Drawing Sheets

SYSTEM AND METHOD FOR ANALYZING POSTURES

FIELD OF THE INVENTION

The present disclosure relates to test technology, and more particularly, to a device and a method for analyzing postures.

BACKGROUND OF THE INVENTION

With development of the modern science and technology, people need to learn and master methods of using sports apparatus while participate in sports. The sports apparatus may be a golf club, a battledore and so on. Taking the golf sport for example, the postures of swinging could be adjusted to achieve optimal postures by practicing and analyzing the postures. Similarly, the postures of swinging in badminton could also be analyzed, so that the nonstandard postures of swinging can be modified.

The conventional posture analyzing system generally includes a computer, a plurality of sensors and a plurality of cameras for capturing photos and recording videos of sports postures. For example, when the participants are practicing in golf sport, the cameras capture the photos and record videos, the sensors are disposed at critical positions of the participants' body and collect signals such as sway, frequency and speed of the body's of the participants, and signals such as speed, rotating angle and strength of the golf club. The signals are analyzed by the computer, and the postures of the golfer are compared with standard postures.

However, the analyzing system needs to be disposed at the body and reset before analyzing postures, and accuracy of the signals is guaranteed by great amount of sensors, therefore structure of the conventional system is very complex.

SUMMARY OF THE INVENTION

One aspect of the present disclosure is to provide a posture analyzing system including: a collecting apparatus disposed on a handle of a sports apparatus and configured to collect and send out sports data of the sports apparatus; a mobile terminal configured to receive the sports data and to draw moving path of the sports apparatus according to the sports data and shape of the sports apparatus.

Another aspect of the present disclosure is to provide a posture analyzing system including: collecting and sending out sports data of the sports apparatus by a collecting apparatus disposed on a handle of a sports apparatus; receiving the sports data and drawing moving path of the sports apparatus according to the sports data and shape of the sports apparatus by a mobile terminal.

DETAILED DESCRIPTION OF THE EMBODIMENTS

The invention will be described in detail with the following embodiments and drawings.

Figure 1:
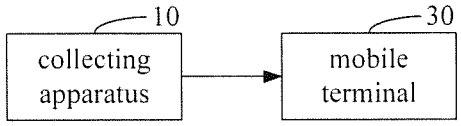
FIG. 1 is a schematic structure of an embodiment of a postures analyzing system.
Figure 2:
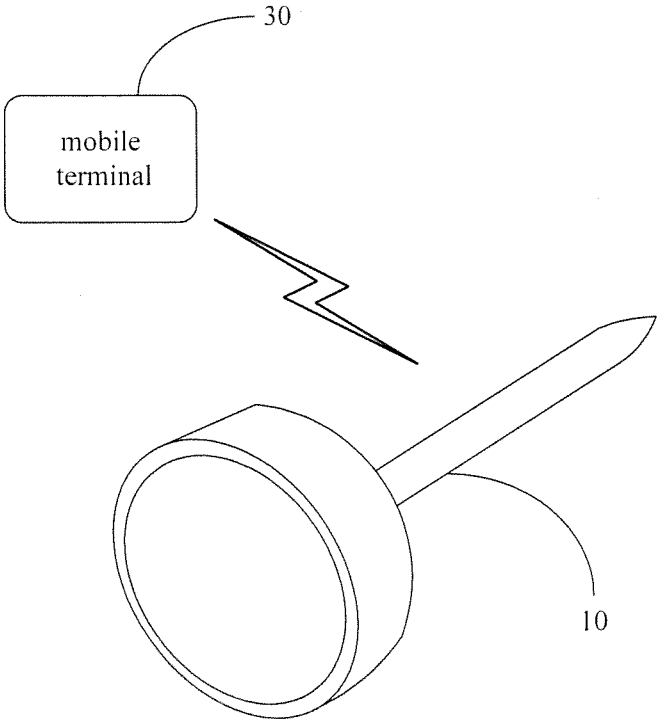
FIG. 2 is an application of the postures analyzing system shown in FIG. 1.

FIG. 1 shows an embodiment of a postures analyzing system at least including a collecting apparatus 10 and a mobile terminal 30. Referring to FIG. 2, the collecting apparatus 10 is disposed on a handle of a sports apparatus. The collecting apparatus 10 is used to collect and send out sports data of the sports apparatus.

In the present embodiment, in order to reduce the adverse effect on the sports apparatus when in use, the size of the collecting apparatus 10 is very small, and is installed on the handle of the sports apparatus by sticking on or embedding in the handle. The collecting apparatus 10 is used to collect the sports data of the sports apparatus such as its rotation and movement and so on. The sports data is sent out through a way of wireless transmission, thus the sports apparatus can be movable for a participant freely.

The mobile terminal 30 is used to receive the sports data and to draw moving path of the sports apparatus according to the sports data and shape of the sports apparatus. In the present embodiment, the mobile terminal 30 obtains movement information such as the moving path, rotation angle and 3-axis acceleration data of the sports apparatus according to the received sports data and the shape of the sports apparatus. The mobile terminal 30 displays movement of the sports apparatus moving with the participant on screen in a way of 3D or 2D.

More specifically, the participant selects type of the sports apparatus stored in the mobile terminal 30 to determine the shape of the sports apparatus. According to the sports data and the shape of the sports apparatus, the mobile terminal 30 shows a video about postures of the participant and moving path of the sports apparatus. The mobile terminal 30 also displays information about swinging speed of the sports apparatus, speed of an end of a golf club and speed of a hand and so on. The mobile terminal 30 may further compare postures of the participant with standard postures so as to correct the postures of the participant.

In order to improve the accuracy of the postures analyzing system, the collecting apparatus 10 is fixed on the top of the handle of the sports apparatus, such that the information, such as the moving path, rotating angle and speed of the sports apparatus, can be calculated correctly only according to the shape information of the sports apparatus, such as the length of the sports apparatus and so on so as to simplify the calculating process. For example, the collecting apparatus 10 is installed in a handle of the golf club, the golfers can swing the golf club by holding the tail end of the golf club, such that the existence of collecting apparatus 10 will not affect the golfers' grips feeling when golfers swing. While participating in sports, take a golf club for example, a golfer should keep movement of swing consistent each time when the golfer practices swinging a golf club repeatedly. In order to determine whether the movement of each swing is consistent, the mobile terminal 30 calculates a face angle, a vertical angle, speed of a front end of the golf club and speed of swinging the golf club according to the sports data, and then determines whether the face angle, the vertical angle, the speed of a front end of the golf club and the speed of swinging the golf club are consistent. If yes, it shows that the movements of the golfer swinging the golf club are consistent.

Figure 3:
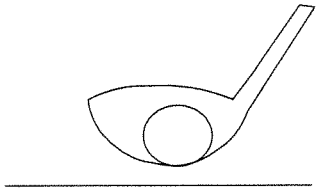
FIG. 3 illustrates a face angle of an embodiment.
Figure 4:
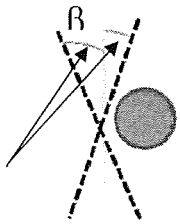
FIG. 4 illustrates the face angle in FIG. 3 briefly.
Figure 5:
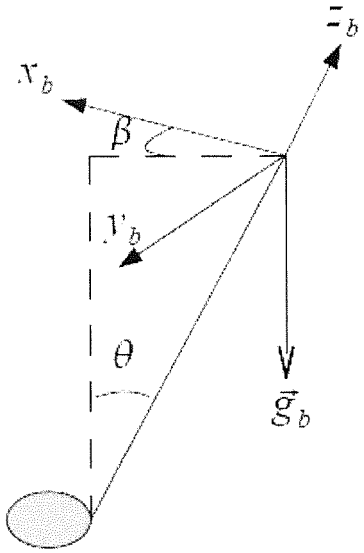
FIG. 5 illustrates angle parameters of a golf club briefly.
Figure 6:
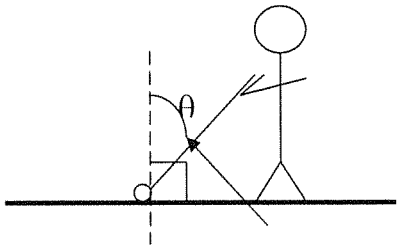
FIG. 6 illustrates a vertical angle of a golf club briefly.

As for the golf sport, the face angle and the vertical angle are important information for measuring a golf player's performance. Referring to FIGS. 3, 4 and 5, the face angle is an angle between a plane of a golf club head and a vertical plane, which is the angle of the golf club head toward the ball and parallel to the ground. β as shown in FIG. 4,5 represents the face angle. The face angle is used to determine a direction that a golf ball flies to. Referring to FIGS. 5 and 6, the vertical angle is an angle between a plane of the golf club and a vertical plane, which is an angle between the ground and the golf club. The vertical angle is used to determine height that the golf ball flies up to, θ shown in FIG. 5 represents the vertical angle.

In the illustrated embodiment, the mobile terminal 30 provides information about postures, rotating angle and speed of the presently used sports apparatus to the participant in real time. For example, in the golf sport, the mobile terminal 30 shares information with the golfers in real time by displaying information about speed of the golf club head, speed of swinging the golf club, speed of the golf club, speed of hands, the face angle, the vertical angle, speed of a golf ball and distance that the golf ball hit away and so on, which help the participant to determine whether the action of swinging the golf club is right.

The mobile terminal 30 is further used to compare the present information of using sports apparatus with the former information of that, and indicate whether the participant has made a progress in using the sports apparatus. Besides, the mobile terminal 30 may get the optimal postures of using the sports apparatus from Internet, and the optimal postures may facilitate the participant to correct the present postures of using the sports apparatus.

Figure 7:
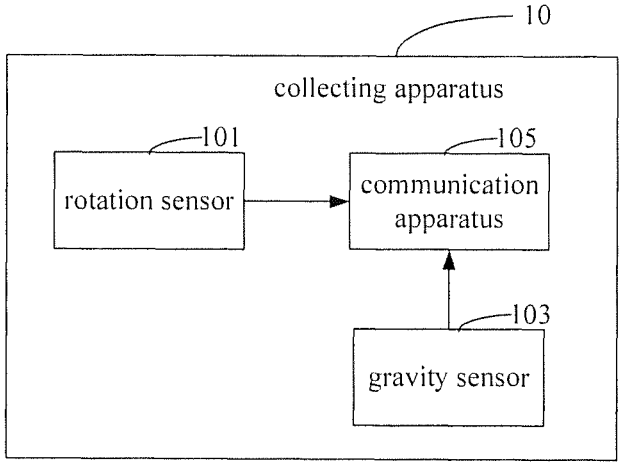
FIG. 7 is a schematic of a collecting apparatus of the embodiment shown in FIG. 1.

In a specified embodiment, the sports data includes rotating angle and 3-axis acceleration data. Referring to FIG. 7, the collecting apparatus 10 includes a rotation sensor 101, a gravity sensor 103, and a communication apparatus 105.

The rotation sensor 101 is used to detect the rotating angle of the sports apparatus. In the present embodiment, when the sports apparatus moves and rotates with the participant, the rotation sensor 101 detects the rotating angles in the X-axis, Y-axis and Z-axis of a three dimensional coordinates in real time. In a preferred embodiment, the rotation sensor 101 is a 3-axis gyro sensor.

The gravity sensor 103 is used to detect 3-axis acceleration data of the sports apparatus. In the present embodiment, when the sports apparatus move with the participant, the gravity sensor 103 detects the 3-axis acceleration data in the X-axis, Y-axis and the Z-axis in real time, such that the 3-axis acceleration data may be feed back to the participant in the following posture analyzing process. In a preferred embodiment, the gravity sensor 103 is a 3-axis G-sensor. Since the cost of the rotation sensor 101 and the gravity sensor 103 is relatively low, such that cost of the posture analyzing system includes the rotation sensor 101 and gravity sensor 103 is decreased.

The communication apparatus 105 is used to send the rotating angle and the 3-axis acceleration data to the mobile terminal 30. In the present embodiment, the communication apparatus 105 exchanges data with the mobile terminal 30 via wireless transmission method such as blue tooth, WIFI and GPRS, therefore the collecting apparatus 10 attached to the sports apparatus, such as a golf club, can be carried as well as the sports apparatus freely.

The rotation sensor 101 collects rotating speed in the X-axis, the Y-axis and the Z-axis in real time, the gravity sensor 103 collects acceleration in the X-axis, the Y-axis and the Z-axis in real time, thus the mobile terminal 30 obtains the movement path, rotating angle and speed of the sports apparatus according to the detected rotation speed and 3-axis acceleration data. Since the data collected by the collecting apparatus 10 are mapped in the 3D coordinates, the accuracy of collecting data can be improved.

Figure 8:
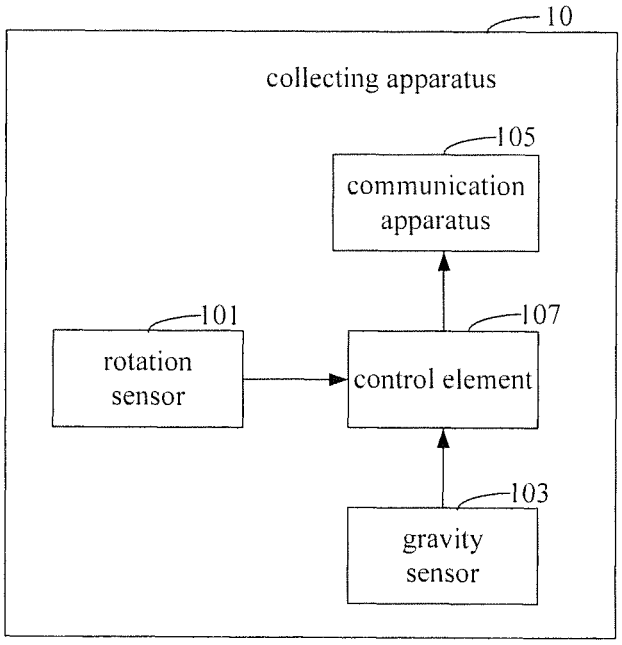
FIG. 8 is another schematic of a collecting apparatus of the embodiment shown in FIG. 1.

In another embodiment, as FIG. 8 shows, the abovementioned collecting apparatus 10 not only includes the rotation sensor 101, the gravity sensor 103 and the communication apparatus 105, but also includes a control element 107.

The control element 107 is used to determine whether the moving path of the sport apparatus is within a range of movement, if yes, the communication apparatus 105 will be turned on, or else the communication apparatus 105 will be turned off or go into sleep mode. In the present embodiment, the control element 107 estimates roughly the moving path of the sport apparatus according to the rotating angle and 3-axis acceleration data to determine an approximate moving path generated in the process of using the sports apparatus by the participant.

Figure 9:
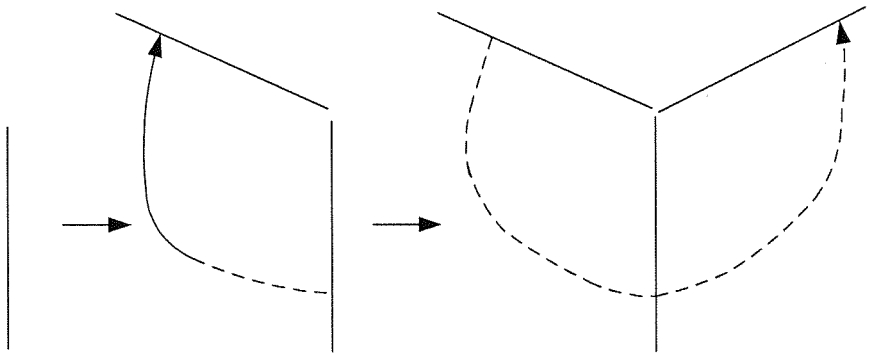
FIG. 9 illustrates an embodiment of a swing movement of a golf club.

When the participant using the sports apparatus, the moving path of the sport apparatus is within a range, for example, for the movement of a golfer swinging a golf club as shown in FIG. 9, when the golfer naturally grips the golf club, the golf club hangs vertically down to the ground and is in an initial state. When the golfer starts to swing the golf club, the golf club is swung up relatively slowly for an angle of 90 degrees to 180 degrees, and then the golf club is swung down relatively fast for an angle of 240 degrees to 360 degrees to finish the whole swinging action. If the moving path estimated by the control element 107 is not in accordance with that of the golfer swinging the golf club, the communication apparatus 105 will be turned off or go into sleep mode, to save power consumption of the collecting apparatus 10. There are other sports apparatus such as badminton also having moving ranges in accordance with its sports apparatus moving routines. By recognizing valid movement from all movements of participants using sports apparatus and further stopping transmitting sports data generated by unexpected movement, the power consumption of the communication apparatus 105 is reduced.

The control element 107 is also used to determine whether the 3-axis acceleration data changes in a time period, if not, the control element 107 will stop operation until the 3-axis acceleration data changes.

In the present embodiment, the control element 107 consumes the most power and the gravity sensor 103 consumes the least. When the 3-axis acceleration data detected by the gravity sensor 103 does not change in a time period, the control element 107 will stop operating so as to reduce the power consumption of the collecting apparatus 10.

The control element 107 is further used to determine whether a time length that the sports apparatus stay in the initial state is larger than a time threshold, if yes, the control element 107 will estimate the moving path of the sports apparatus according to the rotating angle and the 3-axis acceleration data, and then the control element 107 will determine whether the moving path of the sports apparatus is within the range of a sports movement, if yes, the communication apparatus 105 will be turned on, or else the communication apparatus 105 will be turned off or go into the sleep mode.

In the present embodiment, when the gravity sensor 103 detects movement of the sports apparatus, it will trigger the control element 107 to operate again, and the control element 107 will further determine whether a time length that the sports apparatus stay in the initial state is larger than a least preparation time needed, if yes, it shows that the sports apparatus is in a preparing stage, and the rotation sensor 101 can be turned on to detect rotating data. Take golf sport as an example, when the golfer naturally grips the golf club, the golf club hangs vertically downward to the ground and is in an initial state, the initial state will last a few seconds for the golfer swing preparation. The control element 107 will determine whether the time length that the sports apparatus stay in the initial state is larger than a predetermined time threshold, if yes, the golfer is regarded as ready to swing, and the rotation sensor 101 will be turned on to determine further.

Before swinging, chipping or putting a golf club, a golfer will adjust the body to form a setup posture, which is crucial for a better finish of the movement of swinging, chipping or putting, so the collecting apparatus 10 is also used to calculate and display the face angle and vertical angle according to the sports data to help the golfer adjusting the setup posture.

Further, in order to guarantee the accuracy of detecting the setup posture of the golfer, the control element 107 is also used to calculate angle parameters of the sports apparatus according to the 3-axis acceleration data of the sports apparatus, and to determine whether the angle parameters are in a threshold range, if yes, the control element 107 will further determine whether a time length that the angle parameters is within the threshold range exceeds to a time threshold, if yes, the detected posture of using the sports apparatus is determined as the setup posture.

In the present embodiment, the face angle and the vertical angle are important for recognizing the movement of the golf club, so the angle parameters include the face angle and the vertical angle. The face angle and the vertical angle can be calculated according to the 3-axis acceleration data detected by the gravity sensor 103. More specifically, since the golf club cannot be hold absolutely steady, there exists some unexpected movement such as shaking or vibration of the golfer's hand. When the control element 107 determines the face angle and the vertical angle are both out of the predetermined threshold range, the current movement is determined to be a preparing movement. When any one of the face angle and the vertical angle is within the predetermined threshold range, the current movement is determined to be an unexpected movement. When the current movement is determined to be the unexpected movement, the collecting apparatus 10 does not process the unexpected movement, thus reduces the power consumption.

In a preferred embodiment, in order to determine the unexpected movement accurately, the predetermined threshold range includes a first threshold range and a second threshold range. More specifically, the control element 107 determines whether the vertical angle is within the first threshold range; if yes, the control element 107 further determines whether the face angle is within the second threshold range; if yes, the posture of using the golf club is determined to be the setup posture. The first threshold range is preferred to range from about 20 degrees to about 80 degrees, and the second threshold range is preferred to range from about −20 degrees to about 20 degrees.

When the angle parameters are within the predetermined threshold range, in order to guarantee the accuracy of detecting, the control element 107 should further determine a time length that the angle parameters are within the threshold range exceeds a time threshold, if yes, the golfer is determined to be in the setup posture. In a preferred embodiment, the time threshold may be selected from a value ranging from about 1.5 seconds to about 2.5 seconds. In another embodiment, the time threshold may be adjusted to a preferred value that fitted to the practical need for detection.

In an embodiment, when the time length that the angle parameters are within the predetermined threshold range exceeds the time threshold, the posture of using the sports apparatus is determined to be the setup posture. The control element 107 is further used to determine whether the angle parameters are out of the threshold range in a predetermined time period. If the time length that the angle parameters are out of the predetermined threshold range exceeds a predetermined time threshold, the posture of using the sports apparatus is determined to be a valid swinging movement.

Further, when the control element 107 determines the angle parameters being within the predetermined threshold range, and if the time length that the angle parameters are out of the threshold range is within the predetermined time threshold, the control element 107 will determine changes of angle parameters caused by using the sports apparatus to be noise.

In the present embodiment, when the golfer is in a preparing state, it is important for the system to accurately distinguish between the valid movement such as swinging and the unexpected movement such as shaking. The unexpected movement is meaningless to the postures analyzing and the corresponding data is regarded as noise which should be eliminated. Therefore, in order to eliminate the noise efficiently, the control element 107 detects the angle parameters in each predetermined time period to determine whether the angle parameters exceed the threshold range. In a preferred embodiment, the time period may range from about 0.01 to about 0.1 second, while it is not limited to this, and it may be adjusted to fit the practical needs for analyzing.

In another embodiment, after confirming the using posture is the setup posture, the control element 107 is further used to determine one movement in accordance with predetermined conditions to be the valid swinging movement after the current posture is determined to be the setup posture. The predetermined conditions include the acceleration along the X-axis being within a range of movement, the acceleration along the Y-axis exceeding a threshold value, the rotating angle of the X-axis being along a first direction when the golf club is swung up, and the rotating angle of the X-axis being along a second direction when the golf club is swung down.

Figure 10:
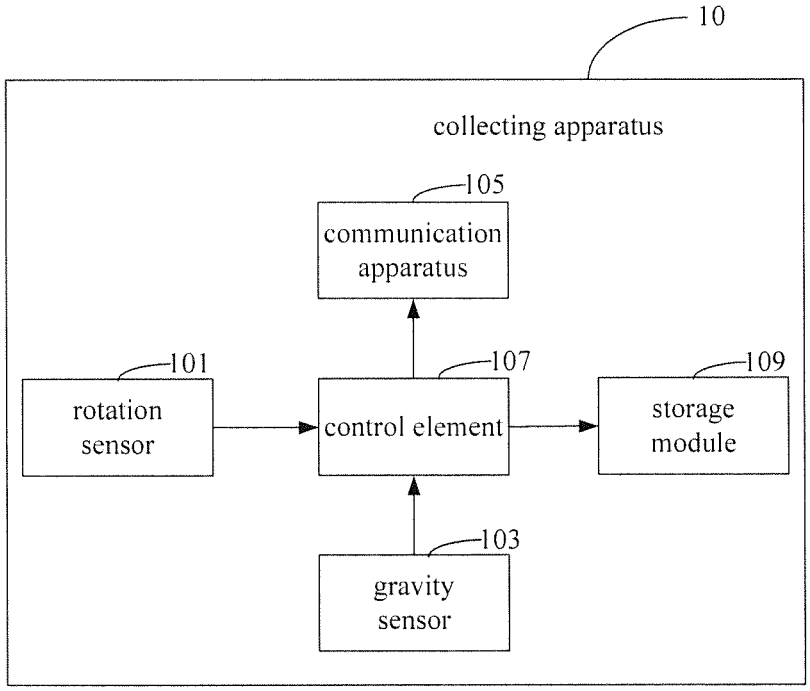
FIG. 10 is a schematic of a collecting apparatus another embodiment.

Referring to FIG. 10, in another embodiment, the above-mentioned collecting apparatus 10 further includes a storage module 109, which is used to store the rotating angle and the 3-axis acceleration data when the communication apparatus 105 is turned off. In the present embodiment, the storage module 109 in the collecting apparatus 10 may effectively avoid missing data in the situations, such as the communication apparatus 105 does not transmit data, the communication apparatus 105 are not ready for transmitting, and the mobile terminal 30 does not receive data because of breaking down.

Figure 11:
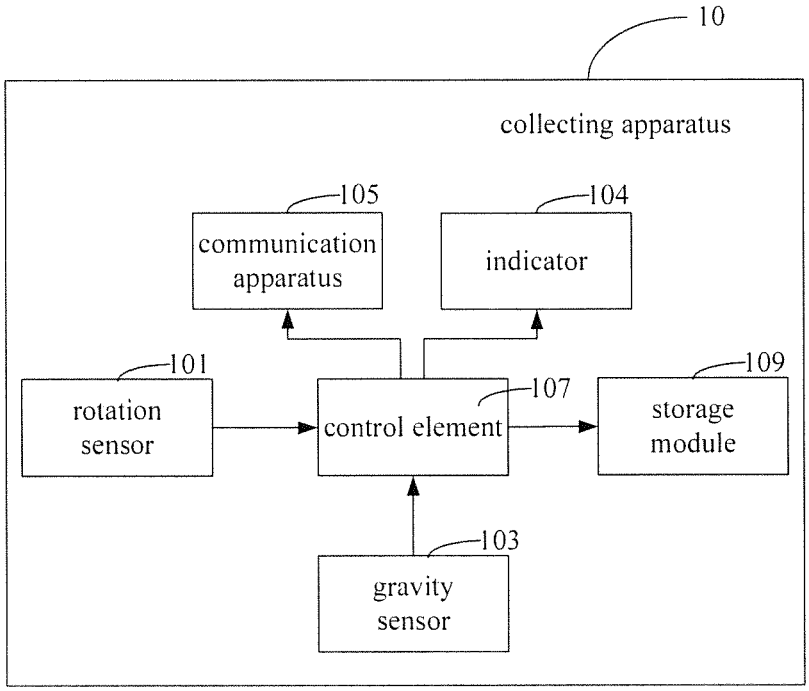
FIG. 11 is a schematic of a collecting apparatus another embodiment.

Referring to FIG. 11, in another embodiment, the abovementioned collecting apparatus 10 further includes an indicator 104, which is used to guide the participants to use the sports apparatus properly according to the angle parameters. In the present embodiment, the indicator 104 is arranged on a golf club. The indicator 104 includes at least one selected from a display screen, a light and a sound module, that is, the indicator 104 guides a golfer via videos, sound and so on. The guiding ways are not limited to the abovementioned, and may include other ways.

More specifically, the display screen is used to display the face angle, the vertical angle, the angle parameters corresponding to optimal postures and difference between angle parameters of the golfer and the angle parameters corresponding to the optimal postures. While swinging, chipping or putting, the golfer may check the angle parameters of present posture via the indicator 104, and further compare with the angle parameters corresponding to the optimal postures to adjust present posture. The angle parameters corresponding to the optimal postures may be from the internet or stored in the collecting apparatus 10 in advance. The storage module 109 is preferred to be a mass storage device for storing all the detected angle parameters including the face angle and the vertical angle.

The light may be an LED light or an LCD light, which may change colors or blink according to the angle parameters of the sports apparatus to guide the golfers to adjust posture. The sound module guides the golfers to adjust posture via sound according to the angle parameters of the sports apparatus, and help golfers to correct the current posture to be the optimal posture.

Figure 12:
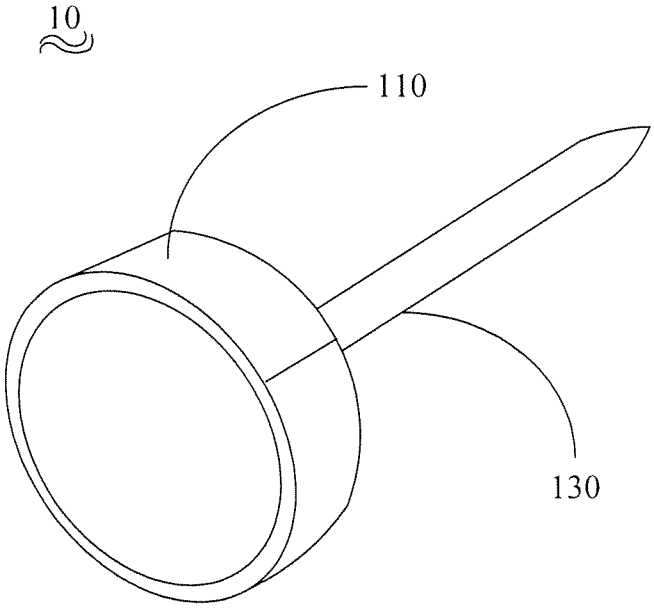
FIG. 12 shows the structure of the collecting apparatus shown in FIG. 1.

Referring to FIG. 12, the collecting apparatus 10 includes an operating member 110 and a fix member 130 connected to the operating member 110. The operating member 110 is disk shaped. Side wall of the operating member 110 defines a USB port for connecting other electronic devices. The fix member 130 is needle shaped. The rotation sensor 101, the gravity sensor 103, the communication apparatus 105, the control element 107 and the storage module 109 are disposed in the operating member 110. The collecting apparatus 10 is inserted in the top of the sports apparatus via the fix member 130, such that the operating member 110 is connected to the sports apparatus tightly. In a preferred embodiment, the operating member 110 has the same diameter with the sports apparatus, so that the handle of the sports apparatus with the collecting apparatus 10 installed can also provide a smooth surface on the side wall for golfers to grip the handle.

Figure 13:
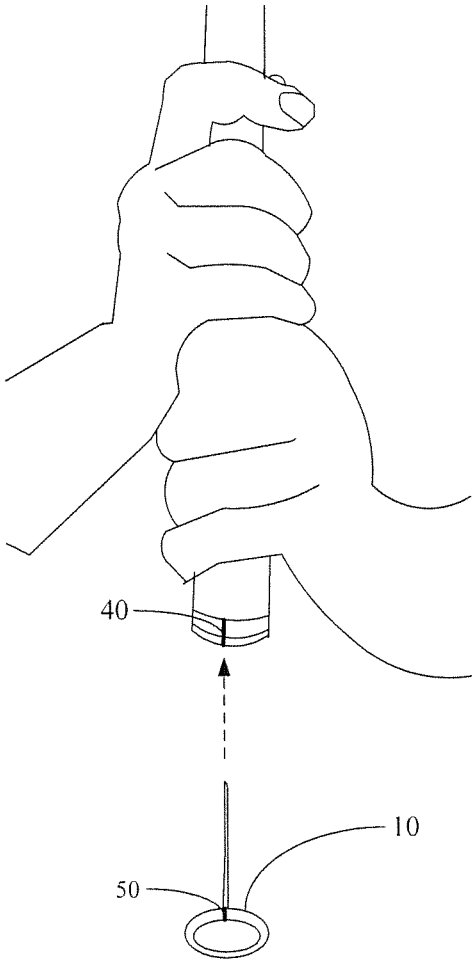
FIG. 13 is a schematic view of assembling the collecting apparatus shown in FIG. 1.

Referring to FIG. 13, an alignment mark 50 is set on the side wall of the operating member 110, and an alignment mark 40 is set on the top of the handle of the sports apparatus. The alignment mark 50 is aligned with the alignment mark 40 for the rotation sensor 101 to provide a reference value while detecting the rotating angle. In a preferred embodiment, the alignment mark 50 is set on the side wall of the operating member 110. The alignment mark 50 is aligned with the alignment mark 40 set on a golf club. Such alignment will set a reference position for the operating member 110 to connect with the handle. A reference value of the rotation sensor 101 can be determined by the reference position. When the golfer swings, the face angle and the vertical angle will be accurately calculated, so that the height and direction that the golf ball flies to will be determined.

Figure 14:
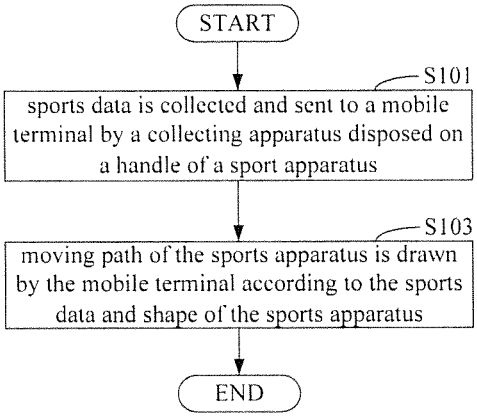
FIG. 14 is a flow chart of a method for analyzing postures of an embodiment.

FIG. 14 illustrate a flow chart of a method for analyzing postures of an embodiment, the method includes following steps.

In step S101, sports data is collected and sent to a mobile terminal by a collecting apparatus arrange on a handle of a sport apparatus.

In the present embodiment, in order to reduce the adverse effect on the sports apparatus when in use, the size of the collecting apparatus is very small, and is installed on the handle of the sports apparatus by sticking on or embedding in the handle. The collecting apparatus 10 is used to collect the sports data of the sports apparatus such as rotating and moving and so on. The sports data is sent out through a way of wireless transmission, thus the sports apparatus can be moveable for a participant freely.

The collecting apparatus can be removably installed on the sports apparatus, when in use, the collecting apparatus can be inserted in the top end of the handle of sports apparatus, it can also be removed. When the users are using the sport apparatus, as the collecting apparatus is installed on the handle, the existence of collecting apparatus will not affect the users' grips feeling when in use.

Figure 15:
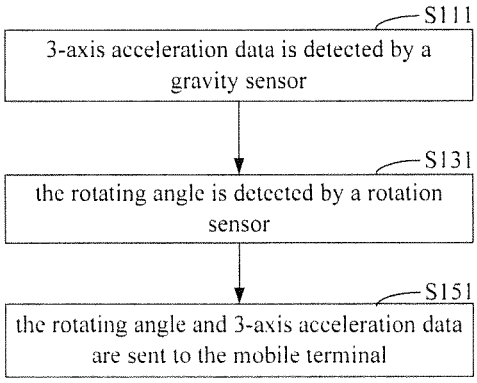
FIG. 15 is a flow chart of collecting and sending sports data.

Referring to FIG. 15, in a specified embodiment, the step of collecting and sending the sports data to a mobile terminal by a collecting apparatus arrange on the handle of a sport apparatus includes the following steps.

In step S111, 3-axis acceleration data is detected by a gravity sensor.

The gravity sensor is used to detect 3-axis acceleration data of the sports apparatus. In the present embodiment, when the sports apparatus move with the participant, the gravity sensor detects the 3-axis acceleration data in the X-axis, Y-axis and the Z-axis in real time, such that the 3-axis acceleration data may be fed back to the participant in the following postures analyzing process.

In step S131, the rotating angle is detected by a rotation sensor. When the sports apparatus moves and rotates with the participant, the rotation sensor detects the rotating angles in the X-axis, Y-axis and Z-axis of a three dimensional coordinates in real time.

The rotation sensor collects rotating speed in the X-axis, the Y-axis and the Z-axis in real time, the gravity sensor collects acceleration in the X-axis, the Y-axis and the Z-axis in real time, thus the mobile terminal obtains the movement path, rotating angle and speed of the sports apparatus according to the above rotation speed and 3-axis acceleration data. Since the data collected by the collecting apparatus are mapped in the 3D coordinates, the data collecting way based on 3D coordinates greatly promote the accuracy of the data.

In step S151, the rotating angle and 3-axis acceleration data are sent to the mobile terminal.

In the present embodiment, the communication apparatus 105 exchanges data with the mobile terminal 30 via wireless transmission method such as blue tooth, WIFI and GPRS, therefore the collecting apparatus 10 arranged in the sports apparatus, such as a golf club, can move with the sports apparatus freely.

In step S103, moving path of the sports apparatus is drawn by the mobile terminal according to the sports data and shape of the sports apparatus. In the present embodiment, the mobile terminal obtains movement information such as the moving path, rotation angle and 3-axis acceleration data of the sports apparatus according to the received sports data and the shape of the sports apparatus. The mobile terminal displays movement of the sports apparatus moving with the participant on screen in a way of 3D or 2D.

More specifically, the participant selects type of the sports apparatus stored in the mobile terminal to determine the shape of the sports apparatus. According to the sports data and the shape of the sports apparatus, the mobile terminal 30 shows a video about postures of the participant and moving path of the sports apparatus. The mobile terminal 30 also displays information about swinging speed of the sports apparatus, speed of an end of a golf club and speed of a hand and so on. The mobile terminal may further compare postures of the participant with standard postures to correct the postures of the participant.

In order to improve the accuracy of the postures analyzing system, the collecting apparatus 10 is arranged on the top of the handle of the sports apparatus, such that the information, such as the moving path, rotating angle and speed of the sports apparatus can be calculated correctly only according to the shape information of the sports apparatus, such as length of the sports apparatus and so on, thus simplifies the calculating process. For example, the collecting apparatus 10 is installed in a handle of the golf club, therefore the golfers can swing the golf club by holding the tail end of the golf club, such that the existence of collecting apparatus 10 will not affect the golfers' grips feeling when golfers swing.

While participating in sports, take a golf club for example, a golfer should keep movement of swing consistent each time when the golfer practice swinging a golf club repeatedly. In order to determine whether the movement of each swing is consistent, the mobile terminal 30 calculates a face angle, a vertical angle, speed of a front end of the golf club and speed of swinging the golf club according to the sports data, and then determines whether the face angle, the vertical angle, the speed of a front end of the golf club and the speed of swinging the golf club are consistent. If yes, it shows that the movements of the golfer swinging the golf club are consistent.

The mobile terminal provides information about postures, rotating angle and speed of the presently used sports apparatus to the participant in real time. For example, in golf sport, the mobile terminal shares information with the golfers in real time by displaying information about speed of the golf club head, speed of swinging the golf club, speed of the golf club, speed of hands, the face angle, the vertical angle, speed of a golf ball and distance that the golf ball hit away and so on, which help the participant to determine whether the action of swinging the golf club is right.

The mobile terminal 30 is further used to compare the present information of using sports apparatus with the former information of the participant, and indicate whether the participant has made any progress in using the sports apparatus. Besides, the mobile terminal 30 may get the optimal postures of using the sports apparatus from internet, and the optimal postures may facilitate the participant to correct the present postures of using the sports apparatus.

Figure 16:
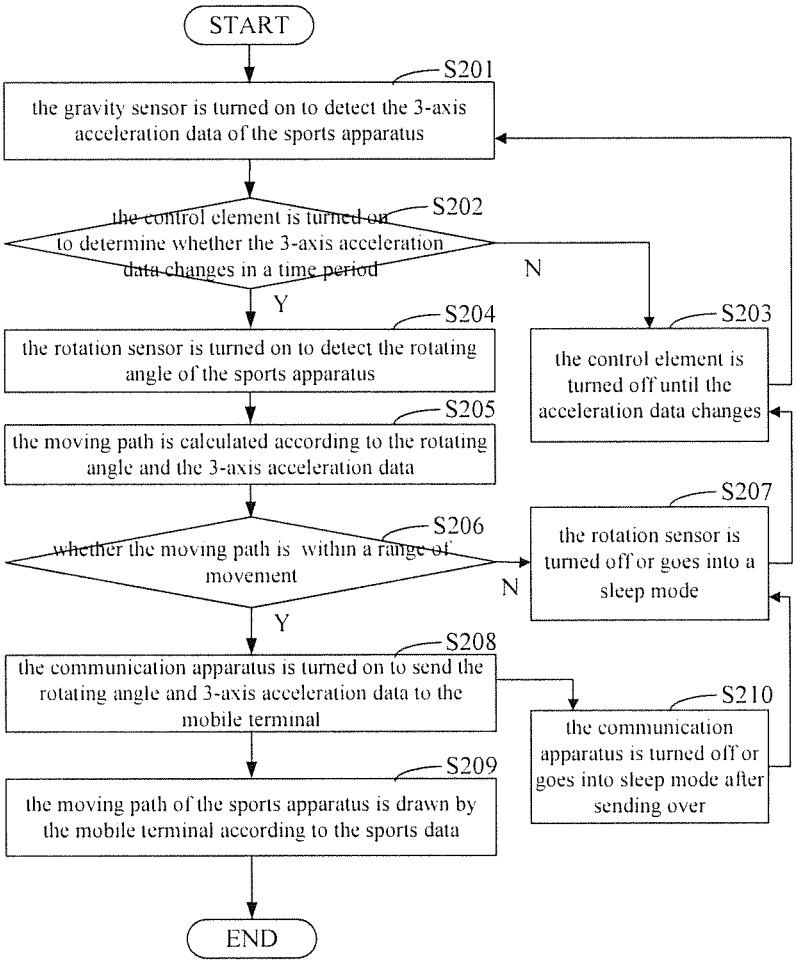
FIG. 16 is a flow chart of a method for analyzing postures of another embodiment.

In another embodiment, referring to FIG. 16, the method for analyzing postures includes the following steps.

In step S201, the gravity sensor is turned on to detect 3-axis acceleration data of the sports apparatus.

In step S202, the control element is turned on to determine whether the 3-axis acceleration data changes in a time period, if not, step S203 will be executed, or else step S204 will be executed.

In the present embodiment, the control element consumes the most power and the gravity sensor 103 consumes the least. When the 3-axis acceleration data detected by the gravity sensor 103 does not change in a time period, the control element 107 will stop operating to reduce the power consumption of the collecting apparatus 10.

In step S203, the control element is turned off until the 3-axis acceleration data changes.

In step S204, the rotation sensor is turned on to detect the rotating angle of the sports apparatus.

In step S205, the moving path is calculated according to the rotating angle and the 3-axis acceleration data.

The control element is used to determine whether the moving path of the sport apparatus is within a range of movement, if yes, the communication apparatus will be turned on, or else the communication apparatus will be turned off or go into sleep mode.

In step S206, whether the moving path is in accordance with a range of movement is determined, if yes, step S208 will be executed, or else step S207 will be executed.

In step S207, the rotation sensor is turned off or goes into a sleep mode, and the step S203 will be executed.

When the participant using the sports apparatus participates in a sport, the moving path of the sport apparatus is within a range, for example, for the movement of a golfer swinging a golf club as shown in FIG. 9, when the golfer naturally handles the golf club, the golf club hangs vertically downward to the ground and is in an initial state. When the golfer swings the golf club, the golf club is swung up relatively slowly for an angle of 90 degrees to 180 degrees, and then the golf club is swung down relatively fast for an angle of 240 degrees to 360 degrees to finish the whole swinging action. If the moving path estimated by the control element 107 is not in accordance with that of the golfer swinging the golf club, the communication apparatus 105 will be turned off or go into sleep mode, to save power consumption of the collecting apparatus 10. There are also moving ranges in accordance with its sport apparatus moving routines of other sports apparatus such as badminton. By recognizing valid movement from all movements of participants using sports apparatus and further stopping transmitting sports data generated from unexpected movement, the power consumption of the communication apparatus 105 is reduced.

More specifically, the step of determining whether the moving path is in accordance with a range of movement includes: determine whether a time length that the sports apparatus stay in the initial state is larger than a time threshold, if yes, the control element 107 will estimate the moving path of the sports apparatus according to the rotating angle and the 3-axis acceleration data, and then the control element 107 will determine whether the moving path of the sports apparatus is within the range of a sports movement, if yes, the step S206 will be executed, or else the rotation sensor will be turned off or go into the sleep mode and the step S201 will be executed.

In the present embodiment, when the gravity sensor 103 detects movement of the sports apparatus, it will trigger the control element 107 to operate again, and the control element 107 will further determine whether a time length that the sports apparatus stay in the initial state is larger than a least prepare time needed, if yes, it shows that the sports apparatus is in a preparing stage, and the rotation sensor 101 can be turned on to detect rotating data. Take golf sport as an example, when the golfer naturally handles the golf club, the golf club hangs vertically down to the ground and is in an initial state, the initial state will last a few seconds for the golfer preparing to swing. The control element 107 will determine whether the time length that the sports apparatus stay in the initial state is larger than a predetermined time threshold, if yes, the golfer is ready to swing, and the rotation sensor 101 will be turned on to determine further.

Before swinging, chipping or putting a golf club, a golfer will adjust the body to build a setup posture, which is crucial for better finish of the movement of swinging, chipping or putting, so the collecting apparatus 10 is also used to calculate and display the face angle and vertical angle according to the sports data to help the golfer adjusting the setup posture.

Figure 17:
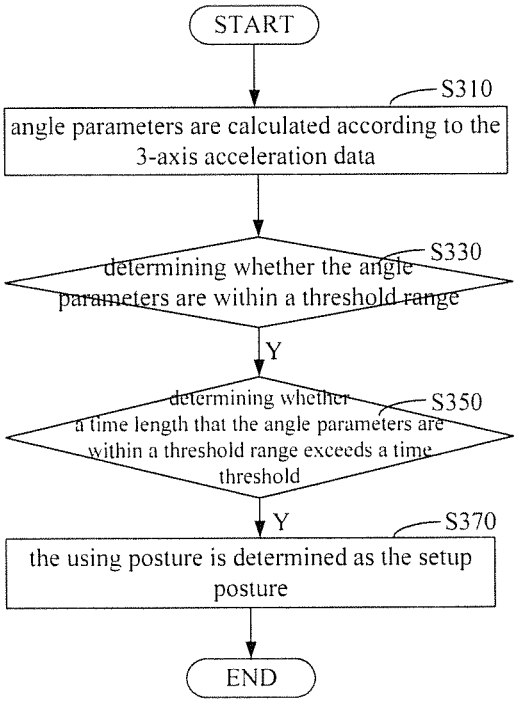
FIG. 17 is a flow chart of a method for analyzing postures of another embodiment.

In an embodiment, referring to FIG. 17, before the step of sending the rotating angle and the 3-axis acceleration data to the mobile terminal, one more step S310 is included.

In step S310, angle parameters are calculated according to the 3-axis acceleration data.

In the present embodiment, the face angle and the vertical angle are important for recognizing the movement of the golf club, so the angle parameters include the face angle and the vertical angle. The face angle and the vertical angle can be calculated according to the 3-axis acceleration data detected by the gravity sensor 103.

In step S330, whether the angle parameters are within a threshold range is determined, if yes, step S350 will be executed.

Since the golf club cannot be hold absolutely steady, there exists some unexpected movement such as shaking or vibration of the golfer's hand. When the control element determines the face angle and the vertical angle are both out of the predetermined threshold range, the current movement is determined to be a preparing movement. When any one of the face angle and the vertical angle is within the predetermined threshold range, the current movement is determined to be an unexpected movement. When the current movement is determined to be the unexpected movement, the collecting apparatus does not process the unexpected movement, thus reduces the power consumption.

In a preferred embodiment, in order to determine the unexpected movement accurately, the predetermined threshold range includes a first threshold range and a second threshold range. More specifically, the control element determines whether the vertical angle is within the first threshold range; if yes, the control element 107 further determines whether the face angle is within the second threshold range; if yes, the posture of using the golf club is determined to be the setup posture. The first threshold range is preferred to range from about 20 degrees to about 80 degrees, and the second threshold range is preferred to range from about −20 degrees to about 20 degrees.

In step S350, whether a time length that the angle parameters is within a threshold range exceeds a time threshold is determined, if yes, the step S370 will be executed.

In the present embodiment, when the golfer is in a prepare state, it is important for the system to distinguish the valid movement such as swinging and the unexpected movement such as shaking. The unexpected movement is meaningless to the posture analyzing and the corresponding data is noise which should be eliminated. Therefore, in order to eliminate the noise efficiently, the control element 107 detects and determines repeatedly, once in a predetermined time period.

When the angle parameters are within the predetermined threshold range, and if the time length that the angle parameters are out of the threshold range is within the predetermined time threshold, the control element 107 will determine changes of angle parameters caused by using the sports apparatus to be noise.

The control element 107 detects and determines repeatedly, once in a predetermined time period. In a preferred embodiment, the time period may range from about 0.01 to about 0.1 second, while it is not limited to this, and it may be adjusted to fit the practical need for analyzing.

In a preferred embodiment, the time threshold may be selected from a value ranging from about 1.5 seconds to about 2.5 seconds. In another embodiment, the time threshold may be adjusted to a preferred value that fitted to the practical need for detection.

In step S370, the using posture is determined to be the setup posture.

In another embodiment, after confirming the using posture is the setup posture, the control element is further used to determine one movement in accordance with predetermined conditions to be the valid movement after the current posture is determined to be the setup posture. The predetermined conditions include the acceleration along the X-axis being within a range of movement, the acceleration along the Y-axis exceeding a threshold value, the rotating angle of the X-axis being along a first direction when the golf club is swung up, and the rotating angle of the X-axis being along a second direction when the golf club is swung down.

In step S208, the communication apparatus is turned on to send the rotating angle and 3-axis acceleration data to the mobile terminals.

In step S209, the moving path of the sports apparatus is drawn by the mobile terminal according to the sports data.

In step S210, the communication apparatus is turned off or goes into sleep mode after sending over.

The communication apparatus is turned off or goes into the sleep mode to save power consumption.

The rotating angle and 3-axis acceleration data can be stored when the communication apparatus is turned off or goes into the sleep mode.

After the step S310, one more step of guiding the participants to use the sports apparatus according to the rotating angle and 3-axis acceleration data is included.

An indicator is used to guide the participants to use the sports apparatus properly according to the angle parameters. In the present embodiment, the indicator 104 is arranged on a golf club. The indicator 104 includes at least one selected from a display screen, a light and a sound module, that is, the indicator 104 guides a golfer via videos and sound and so on. The guiding ways are not limited to the abovementioned, and may include more other ways.

More specifically, the display screen is used to display the face angle, the vertical angle, angle parameters corresponding to optimal postures and difference between angle parameters of the golfer and the angle parameters corresponding to the optimal postures. While swinging, chipping or putting, the golfer may check the angle parameters of present posture via the indicator 104, and further compare with the angle parameters corresponding to the optimal postures to adjust present posture. The angle parameters corresponding to the optimal postures may be from the internet or stored in the collecting apparatus 10 in advance. The storage module 109 is preferred to be a mass storage device for storing all the detected angle parameters including the face angle and the vertical angle.

The light may be an LED light or an LCD light, which may change colors or blink according to the angle parameters of the sports apparatus to guide adjusting posture. The sound module guides adjusting posture via sound according to the angle parameters of the sports apparatus, and help golfers to correct the current posture to be the optimal posture.

The mobile terminal in the above embodiments may be easy portable electronic devices such as smart phones, PDAs and so on.

Figure 18:
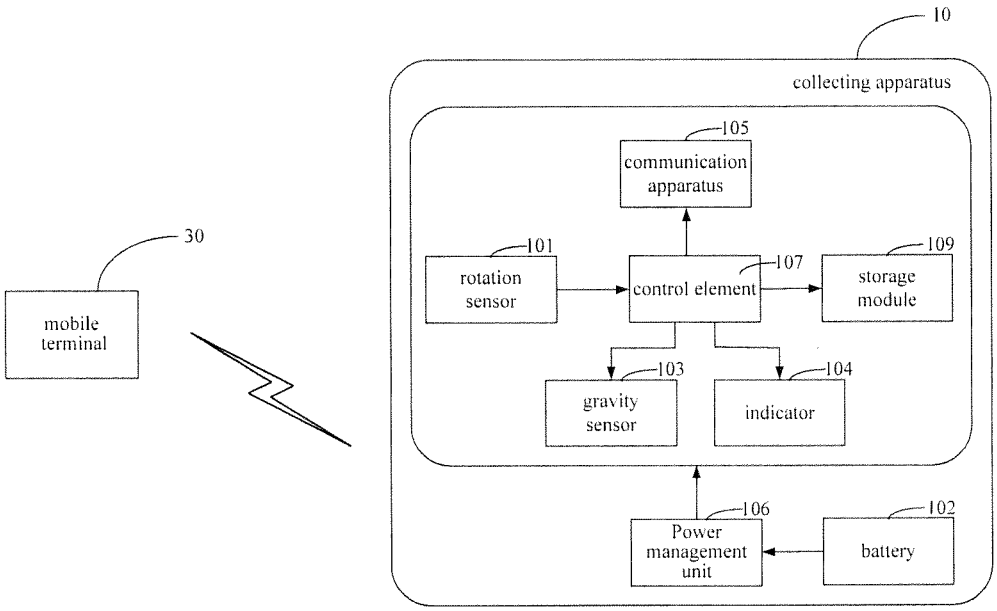
FIG. 18 is an application of the postures analyzing system of an embodiment.

Referring to FIG. 18, in the system and method for analyzing postures, in order to manage power consumption, a power management unit 106 is included. The power management unit is used to adjust power consumption of the rotation sensor 101, gravity sensor 103, indicator 104, communication apparatus 105, control element 107 and storage module 109 to improve portability and endurance of the system for a purpose of low power operating.

Referring to FIG. 18, a golf club is taken as an example to illustrate processing flow of the method and system of the present embodiment. The collecting apparatus 10 includes a battery 102 inside to provide power to elements of the collecting apparatus 10, such that the system can be used by golfers whenever and wherever possible. Since the gravity sensor 103 consumes the least power, it is firstly turned on to detect the 3-axis acceleration data.

The 3-axis acceleration data detected by the gravity sensor 103 is sent to the control element 107 to determine whether the 3-axis acceleration data changes, if yes, it shows that the golf club moves, then the rotation sensor is turned on to detect the rotating angle. If the 3-axis acceleration data did not change, the control element 107 will be turned off or go into sleep mode.

After the rotation sensor 101 is turned on, the rotating angle will be detected by the rotation sensor 101. The control element 107 estimates the moving path of the golf club according to the rotating angle and the 3-axis acceleration data, and further determines whether the moving path of the golf club is within the range of movement, if yes, it shows that the movement of the golfer is a valid movement, so the rotating angle and the 3-axis acceleration data will be send out, or else the movement of the golfer is considered as an unexpected movement. The rotating angle and the 3-axis acceleration data are not valid data and will not be send out, in order to save the power consumption of the communication apparatus 105.

The mobile terminal 30 calculates the moving path of the golfers according to the received rotating angle and 3-axis acceleration data.

The above method and system dispose the collecting apparatus on the handle of the sports apparatus to collect the sports data. There is no need to install a great amount of sensors on the participants' body, such that the cost and complexity is decreased.

The above method and system dispose the collecting apparatus on the top of the sports apparatus to obtain the moving path accurately only according to the shape of the sports apparatus, which simplifies the process of obtaining the moving path.

By recognizing valid movement from all movements of participants using sports apparatus and further stopping transmitting sports data generated from unexpected movement, the power consumption of the communication apparatus is reduced.

Whether the control element is stopped operation is determined according to the change of the 3-axis acceleration data, if yes, the control element will stop operation to save the power consumption.

Although the present invention has been described with reference to the embodiments thereof and the best modes for carrying out the present invention, it is apparent to those skilled in the art that a variety of modifications and changes may be made without departing from the scope of the present invention, which is intended to be defined by the appended claims.

What is claimed is:

1. A postures analyzing system, comprising:

a collecting apparatus disposed on a handle of a sports apparatus and configured to collect and send out sports data of the sports apparatus, the sports data includes rotating angle and 3-axis acceleration data and the collecting apparatus including:

a rotation sensor for detecting the rotating angle of the sports apparatus;

a gravity sensor for detecting the 3-axis acceleration data of the sports apparatus; and a communication apparatus;

a mobile terminal configured to receive the rotating angle and 3-axis acceleration data of the sports data sent by the communication apparatus and to draw moving path of the sports apparatus according to the sports data and shape of the sports apparatus, wherein the collecting apparatus further includes a control element for determining whether the moving path of the sport apparatus is within a range of movement, if yes, the communication apparatus will be turned on, or else the communication apparatus will be turned off or go into a sleep mode, the control element being configured to calculate angle parameters of the sports apparatus according to the 3-axis acceleration data and to determine whether the angle parameters are within a threshold range, if yes, the control element further determining whether a time length that the angle parameters are within the threshold range exceeds to a time threshold, if yes, posture of using the sports apparatus is determined to be the setup posture.

2. The postures analyzing system of claim 1, wherein the collecting apparatus further comprises a storage module for storing the rotating angle and the 3-axis acceleration data when the communication apparatus is turned off.

3. The postures analyzing system of claim 1, wherein the control element is further configured to determine whether the 3-axis acceleration data changes in a time period, if not, the control element will stop operation until the 3-axis acceleration data changes.

4. The postures analyzing system of claim 3, wherein the control element is further configured to determine whether a time length that the sports apparatus stay in an initial state is larger than a time threshold, if yes, the control element will estimate the moving path of the sports apparatus according to the rotating angle and the 3-axis acceleration data, and then the control element will determine whether the moving path of the sports apparatus is within a range of a sports movement, if yes, the communication apparatus will be turned on, or else the communication apparatus will be turned off or go into the sleep mode.

5. The postures analyzing system of claim 1, wherein the angle parameters comprise a face angle and a vertical angle.

6. The postures analyzing system of claim 1, when the time length that the angle parameters are within the predetermined threshold range exceeds the time threshold, the posture of using the sports apparatus being determined to be the setup posture, the control element is further configured to determine whether the angle parameters are out of the threshold range in a predetermined time period, if the time length that the angle parameters are out of the predetermined threshold range exceeds the predetermined time threshold, the posture of using the sports apparatus is determined to be a valid swinging movement.

7. The postures analyzing system of claim 6, when the control element determines the angle parameters being within the predetermined threshold range, and if the time length that the angle parameters are out of the threshold range is detected to be within the predetermined time threshold, the control element will determine changes of angle parameters caused by using the sports apparatus to be noise.

8. The postures analyzing system of claim 1, wherein the control element is further configured to determine a movement in accordance with predetermined conditions to be the valid movement; and the predetermined conditions comprise acceleration along the X-axis being within a range of movement, the acceleration along the Y-axis exceeding a threshold value, rotating angle of the X-axis being along a first direction when the golf club is swung up and the rotating angle of the X-axis being along a second direction when the golf club is swung down.

9. The postures analyzing system of claim 1, wherein the collecting apparatus further comprises an indicator configured to guide participants to use the sports apparatus properly according to the angle parameters.

10. The postures analyzing system of claim 9, wherein the indicator comprises at least one selected from a display, a light and a sound module.

11. The postures analyzing system of claim 1, wherein the collecting apparatus comprises an operating member and a fix member connected to the operating member, the operating member is disk shaped, the fix member is needle shaped, and the collecting apparatus is inserted in the top of the sports apparatus via the fix member.

12. The postures analyzing system of claim 11, wherein the operating member has the same diameter with the sports apparatus.

13. The postures analyzing system of claim 12, wherein an alignment mark is set on a side wall of the operating member, and an alignment mark is set on the top of the handle of the sports apparatus, the alignment mark of the operating member is aligned with the alignment mark of the handle for the rotation sensor to provide a reference value while detecting the rotating angle.

14. A postures analyzing method, comprising:

collecting and sending out sports data of the sports apparatus by a collecting apparatus disposed on a handle of a sports apparatus, the sports data including rotating angle and 3-axis acceleration data, the step of collecting and sending out sports data of the sports apparatus by a collecting apparatus disposed on a handle of a sports apparatus includes:

detecting the rotating angle of the sports apparatus by a rotation sensor;

detecting the 3-axis acceleration data of the sports apparatus by a gravity sensor;

estimating a moving path of the sports apparatus according to the rotating angle and 3-axis acceleration data;

determining whether the moving path of the sport apparatus is within a range of movement, if yes, the communication apparatus will be turned on, or else the communication apparatus will be turned off or go into a sleep mode;

calculating angle parameters of the sports apparatus according to the 3-axis acceleration data of the sports apparatus;

determining whether the angle parameters are in a threshold range, if yes, the control element will further determine whether a time length that the angle parameters is within the threshold range exceeds to a time threshold, if yes, posture of using the sports apparatus is determined to be the setup posture;

sending the rotating angle and 3-axis acceleration data to a mobile terminal by a communication apparatus; and receiving the sports data and drawing the moving path of the sports apparatus according to the sports data and shape of the sports apparatus by the mobile terminal.

15. The postures analyzing method of claim 14, the step of collecting and sending out sports data of the sports apparatus by a collecting apparatus disposed on a handle of a sports apparatus further comprising: storing the rotating angle and the 3-axis acceleration data which are stopped to be sent out.

16. The postures analyzing method of claim 14, before the step of estimating the moving path of sports apparatus according to the rotating angle and 3-axis acceleration data, further comprising: determining whether the 3-axis acceleration data changes in a time period, if not, the control element will stop operation until the 3-axis acceleration data changes, or else the moving path will be estimated according to the rotating angle and the 3-axis acceleration data.

17. The postures analyzing method of claim 14, wherein the step of determining whether the moving path of the sport apparatus is within a range of movement comprises: determining whether a time length that the sports apparatus stay in an initial state is larger than a time threshold, if yes, the control element will estimate the moving path of the sports apparatus according to the rotating angle and the 3-axis acceleration data, and then the control element will determine whether the moving path of the sports apparatus is within a range of a sports movement, if yes, the rotating angle and the 3-axis acceleration data will be sent to the mobile terminal, or else the acceleration of the sports apparatus will be detected by the gravity sensor.

18. The postures analyzing method of claim 14, wherein the angle parameters comprise a face angle and a vertical angle.

19. The postures analyzing method of claim 14, after the step of determining the angle parameters to be within the predetermined threshold range, and the time length that the angle parameters are within the threshold range to exceed the predetermined time threshold, further comprising: detecting whether the angle parameters are out of a threshold range, if yes, detecting whether a time length that the angle parameters are out of a threshold range is larger than a predetermined time period, if yes, the posture of using the sports apparatus is determined to be a valid swinging movement.

20. The postures analyzing method of claim 19, further comprising: determining changes of angle parameters caused by using the sports apparatus to be noise when the angle parameters of the sports apparatus are determined to be within the predetermined threshold range, and if the time length that the angle parameters are out of the threshold range is detected to be within the predetermined time threshold.

21. The postures analyzing method of claim 14, after the current posture is determined as the setup posture, further comprising: determining one movement in accordance with predetermined conditions to be the valid movement, wherein the predetermined conditions comprise the acceleration along the X-axis being within a range of movement, the acceleration along the Y-axis exceeding a threshold value, the rotating angle of the X-axis being along a first direction when the golf club is swung up, and the rotating angle of the X-axis being along a second direction when the golf club is swung down.

22. The postures analyzing method of claim 14, after the step of calculating angle parameters of the sports apparatus according to the 3-axis acceleration data of the sports apparatus, further comprising: guiding the participants to use the sports apparatus properly according to the angle parameters.

23. A postures analyzing system, comprising:

a collecting apparatus disposed on a handle of a sports apparatus and configured to collect and send out sports data of the sports apparatus, the collecting apparatus including a rotation sensor for detecting a rotating angle of the sports apparatus, an operating member and a fix member connected to the operating member, the operating member being disk shaped and having the same diameter as the sports apparatus, the fix member being needle shaped, and the collecting apparatus being inserted in the top of the sports apparatus via the fix member, an alignment mark being set on a side wall of the operating member, and an alignment mark being set on a top of the handle of the sports apparatus, the alignment mark of the operating member being aligned with the alignment mark of the handle to provide a reference value for the rotation sensor to detect the rotating angle of the sports apparatus;

a mobile terminal configured to receive the sports data and to draw moving path of the sports apparatus according to the sports data and shape of the sports apparatus.

* * * * *